US007578275B2

(12) United States Patent
Pfutzenreuter

(10) Patent No.: US 7,578,275 B2
(45) Date of Patent: Aug. 25, 2009

(54) DEVICE FOR VARIABLY SETTING THE CONTROL TIMES OF GAS EXCHANGE VALVES OF AN INTERNAL COMBUSTION ENGINE

(75) Inventor: Lars Pfutzenreuter, Werdohl (DE)

(73) Assignee: AFT Atlas Fahrzeugtechnik GmbH, Werdohl (DE)

( * ) Notice: Subject to any disclaimer, the term of this patent is extended or adjusted under 35 U.S.C. 154(b) by 151 days.

(21) Appl. No.: 11/914,813

(22) PCT Filed: May 10, 2006

(86) PCT No.: PCT/EP2006/004381

§ 371 (c)(1),
(2), (4) Date: Nov. 19, 2007

(87) PCT Pub. No.: WO2006/136239

PCT Pub. Date: Dec. 28, 2006

(65) Prior Publication Data

US 2008/0184949 A1 Aug. 7, 2008

(30) Foreign Application Priority Data

May 20, 2005 (DE) ..... 10 2005 023 204

(51) Int. Cl.
*F01L 1/34* (2006.01)

(52) U.S. Cl. ..... 123/90.17; 123/90.15; 123/90.31

(58) Field of Classification Search ..... 123/90.17, 123/90.15, 90.31
See application file for complete search history.

(56) References Cited

U.S. PATENT DOCUMENTS 6,053,139 A 4/2000 Eguchi et al.
6,668,778 B1 12/2003 Smith
2002/0043231 A1 4/2002 Hase
2004/0055550 A1 * 3/2004 Smith ..... 123/90.17

FOREIGN PATENT DOCUMENTS

EP 0857859 8/2003
EP 1371818 12/2003
EP 1531240 5/2005
EP 1400661 7/2006

* cited by examiner

*Primary Examiner*—Zelalem Eshete
(74) *Attorney, Agent, or Firm*—Volpe and Koenig, P.C.

(57) ABSTRACT

A device for variably setting the control times of gas exchange valves of an internal combustion engine is provided having a hydraulic actuator (18) with two reciprocally operating pressure chambers (12, 13) and with a pressure medium supply device (32) for supplying and withdrawing pressure medium to or from the pressure chambers (12, 13). The device (1) also includes at least one rotation angle limiting device (24) that in an unlocked state does not limit the phasing of the output element (3) in reference to the input element (2) but, in a locked state, limits it to a defined angular range or to a defined angle, with the rotation angle limiting device (24) being switched from the locked to the unlocked state by pressure medium being supplied. A control line (19) is provided for supplying and withdrawing pressure medium to or from the rotation angle limiting devices (24), with the control line (19) not communicating with the pressure medium supply device (32). A control valve (38) controls the supply and withdrawal of pressure medium to and from the control line (19). The control valve (38) comprises a hydraulic actuating mechanism (39) that is subjected to the action of pressure medium from the pressure medium supply device (32).

14 Claims, 4 Drawing Sheets

DEVICE FOR VARIABLY SETTING THE CONTROL TIMES OF GAS EXCHANGE VALVES OF AN INTERNAL COMBUSTION ENGINE

BACKGROUND

The invention relates to a device for variably setting the control times of gas exchange valves of an internal combustion engine according to the preambles of claims 1 and 2.

In internal combustion engines, camshafts are used to operate the gas exchange valves. Camshafts are arranged in the internal combustion engine such that the cams arranged on them contact the cam followers, such as for example flat-based tappets, finger levers, and rocker arms. When a camshaft is made to rotate, the cams roll over the cam followers, which in turn operate the gas exchange valves. Therefore, both the duration of the opening as well as the opening amplitude and the opening and closing times of the gas exchange valves are determined by the position and the shape of the cams.

Modern motor concepts tend to design the valve drive in a variable fashion. On the one hand, the valve stroke and the duration of the valve opening shall be designed variably, up to completely shutting off individual cylinders. For this purpose, concepts are provided, such as for example cam followers or electro-hydraulic or electric valve actuators that can be switched. Furthermore, it has proven advantageous when the opening and closing times of the gas exchange valves can be influenced during the operation of the internal combustion engine. Here, it is particularly desired when the opening and/or closing times of the intake and/or exhaust valves can be influenced separately, in order to adjust a defined valve overlap in a targeted manner, for example. By adjusting the opening and/or closing times of the gas exchange valves depending on the actual range of the ignition map of the engine, for example the actual rotation and/or the actual load, the specific fuel consumption can be lowered, the exhaust behavior can be influenced beneficially, and the effectiveness of the engine, the maximum torque, and the maximum output can be increased.

The variability of the valve control times described is achieved by a relative change of the camshaft phasing in reference to the crankshaft. Here, the camshaft is usually connected to the crankshaft in a driving fashion via chain, belt, toothed wheel, or drive concepts operating in the same manner. A device for changing the control times of the internal combustion engine is arranged between the chain, belt, or toothed wheel drive driven by the crankshaft and the camshaft, in the following also called a camshaft adjuster, which transfers the torque from the crankshaft to the camshaft. Here, this device is embodied such that during the operation of the internal combustion engine, the phasing of the camshaft in reference to the crankshaft is held securely and, if desired, the camshaft can be rotated in reference to the crankshaft within a certain angular range.

In internal combustion engines provided with one camshaft for each of the intake and the exhaust valves, the valves can be separately provided with one camshaft adjuster. This way the opening and closing times of the intake and exhaust valves can be temporarily shifted in reference to each other and valve overlaps can be adjusted in a targeted manner.

The location of modern camshaft adjusters is usually at the driving end of the camshaft. The camshaft adjuster may also be arranged on an intermediate shaft, a non-rotating component, or the crankshaft. It comprises a driving wheel, driven by the crankshaft and being in a fixed phasing in reference thereto, an output part being in a driving connection with the camshaft, and an adjustment mechanism transferring the torque from the drive wheel to the output part. In case the camshaft adjuster is not arranged at the crankshaft, the drive wheel can be embodied as a chain, belt, or toothed wheel and driven by the crankshaft via a chain, belt, or a toothed wheel drive. The adjustment mechanism can be operated electrically (by a driven three-stage planetary gear), hydraulically, or pneumatically.

The so-called axial piston adjusters and rotary piston adjusters represent two preferred embodiments of hydraulically adjustable camshaft adjusters.

In axial piston adjusters the drive wheel contacts a piston and said piston the output part, each via helical gearing. The piston separates a hollow space, formed by the output part and the drive wheel, into two pressure chambers arranged axially in reference to each other. If now one pressure chamber is impinged with a pressure medium while the other pressure chamber is connected to a reservoir the piston is displaced in the axial direction. By the helical gearing the axial displacement of the piston is converted into a relative rotation of the drive wheel in reference to the output part and thus of the camshaft in reference to the crankshaft.

A second embodiment of hydraulic camshaft adjusters is represented by the so-called rotary piston adjusters. Here, the drive wheel is connected to a stator in a fixed manner. The stator and a rotor are arranged concentrically in reference to each other, with the rotor being connected to a camshaft, an extension of the camshaft, or an intermediate shaft in a force, form, or material-fitting manner, for example via an interference fit, a screwed, or a welded connection. In the stator, several hollow spaces are formed, spaced apart in the circumferential direction, which extend radially outward starting at the rotor. The hollow spaces are bounded in a pressure-tight manner in the axial direction by side caps. A blade, connected to the rotor, extends into each of these hollow spaces dividing each hollow space into two pressure chambers. By a targeted connection of the individual pressure chambers to a pressure medium pump, and/or a reservoir the phasing of the camshaft in reference to the crankshaft can be adjusted and/or upheld.

Sensors detect the characteristics of the engine, such as for example the load condition and the rpm's in order to control the camshaft adjuster. These characteristics are fed to an electronic control unit, which controls the inlet and outlet of pressure medium to the different pressure chambers after a comparison with data (saved) in a data sheet of the internal combustion engine.

In order to adjust the camshaft phasing in reference to the crankshaft in hydraulic camshaft adjusters one of the two reciprocally operating pressure chambers of a hollow space is connected to a pressure medium pump and the other one to a reservoir. The supply of pressure medium to one chamber combined with the outlet of pressure medium from the other chamber displaces the piston separating the pressure chambers in the axial direction, so that in axial piston adjusters, the camshaft is rotated in reference to the crankshaft via the helical gearing. In rotary piston adjusters a displacement of the blade is affected by the impingement of one chamber with pressure and pressure release of the other chamber and thus directly rotates the camshaft in reference to the crankshaft. In order to uphold the phasing both pressure chambers are either connected to a pressure medium pump or both of them are separated from the pressure medium pump and the reservoir.

The control of the flow of pressure medium and/or the pressure chambers occurs via a control valve, usually a 4/3 proportional valve. Each valve housing is provided with one connector for the pressure chambers (operating connector), a connector for the pressure medium pump, and at least one connector to a reservoir. An axially displaceable control piston is arranged within the valve housing essentially embodied in a hollow cylindrical fashion. The control piston can be brought into any axial position between two defined end positions via an electro-magnetic actuator counteracting the spring force of a spring element. The control piston is further provided with circular grooves and control edges, by which the individual pressure chambers can be optionally connected to the pressure medium pump or the reservoir. Similarly, an adjustment of the control piston can be provided, in which the pressure medium chambers are separated both from the pressure medium pump as well as the pressure medium reservoir.

During the starting phase of the internal combustion engine, the camshaft adjusters need a certain amount of time until the phasing can be held securely. In case of a hydraulic camshaft adjuster this is caused in that during the off state of the internal combustion engine, the pressure medium exits the pressure chambers and thus during the start of the internal combustion engine the hydraulic clamping of the piston and/or the blade is not ensured. The camshaft phasing in reference to the crankshaft is not fixed until the oil pump of the internal combustion engine, driven by the camshaft sufficiently provides the camshaft adjuster with pressure medium. Thus, poor start and operating characteristics of the internal combustion engine result. Furthermore, the piston or the blades inside the pressure chambers can be adjusted in an unlimited manner due to the reaction moments of the camshaft, which cause them to hit stops in the device, resulting in noise and causing wear.

This is counteracted such that a rotational angle limiting device is provided, which mechanically couples the output element to the input element and thus prevent a rotation of the two components in reference to each other. Such rotational angle limiting devices are realized by a locking piston, which is arranged in a receiver embodied either in the input element or the output element. Furthermore, a spring is provided, which urges the locking piston into the direction of the other component. Furthermore, a link is provided at the other component, into which the locking piston is pushed when a predetermined locking phase is reached.

Here, it can be advantageous to lock the output element in reference to the input element in one of the two extreme phase positions or in a phase position therebetween. Depending on the application, one or more locking devices are provided, in which the link in the second case can be embodied as a blind hole or a groove extending in the circumferential direction.

In DE 698 17 413 T2 such a device is shown. It relates to a device in a rotary piston design. An input element, being in driven connection with a crankshaft, is supported in a rotary fashion on an output element, connected to a camshaft in a non-rotatable manner. The input element is embodied with recesses open towards the output element. In the axial direction of the device, side caps are provided limiting the device. The recesses are sealed in a pressure tight manner by the input element, the output element, and the side caps and thus form pressure chambers. In the exterior casing surface of the output element, axial grooves are inserted, in which blades are arranged extending into the recesses. The blades are embodied such that they divide the pressure chambers into two reciprocally operating pressure chambers. By supply and/or withdrawal of pressure medium to and/or from the pressure chambers the camshaft phasing in reference to the crankshaft can be held or adjusted.

A locking piston is arranged in the input element, which is impinged by a force of a spring in the direction of the output element. A blind hole is provided at an external casing surface of the output element facing the locking piston. The blind hole is arranged and embodied such that, in a defined phase of the output element in reference to the input element, the locking piston engages the blind hole, when not impinged with the pressure medium. The rotor is therefore locked in reference to the stator, thus preventing a relative rotation. Pressure medium is supplied to the blind hole via a control line, by which a face of the locking piston is impinged with pressure medium. In this manner, the piston is pressed into the receiver and a rotation of the rotor in reference to the stator is allowed in one direction. The control line is provided separate from a device for supplying pressure medium, impinging the pressure chambers with pressure medium. Furthermore, a switch-over valve is provided, which controls the supply and/or withdrawal of pressure medium of the control line. This control valve is switched via a microprocessor and an electromagnetic control unit from a position, in which the pressure medium is withdrawn from the blind hole, into a condition, in which the blind hole is impinged with pressure medium.

Here, the high expenses are disadvantageous arising from the separate control line being operated via an electromagnetic control unit. In order to loosen the lock of the output element in reference to the input element only when the device is filled sufficiently with pressure medium this state must be detected or a certain period of time after the start of the internal combustion engine must be awaited before the switch-over valve is operated. In the first case, sensors must be provided, which must be supervised by the ECU of the internal combustion engine, which leads to higher costs and an increased control expense. In the second case the locking can be released before the desired fill state of the device is reached, which leads to the above-mentioned disadvantages.

SUMMARY

The invention is therefore based on the object of avoiding the above-described disadvantages and thus to provide a device for variably adjusting the control times of gas exchange valves of an internal combustion engine, in which the locking of the output element in reference to the input element occurs in a secure process only after the target fill state of the device has been reached, with this being achieved without any additional costly components, such as electromagnetic actuators, and with a control expense as little as possible.

In a first embodiment of a device for variably adjusting the control times of gas exchange valves of an internal combustion engine of an output element driving a camshaft, an input element driven by a crankshaft, a hydraulic actuator with at least two reciprocally operating pressure chambers, and a device to supply pressure medium for the supply and withdrawal of pressure medium to and/or from the pressure chambers, in which the input element is arranged to be rotatable in reference to the output element and phasing between the two components can be optionally upheld or adjusted by supplying or withdrawing pressure medium, at least one rotation angle limiting device is provided, which in the unlocked state does not limit the phasing of the output element in reference to the input element and in a locked state limits a defined angular range or a defined angle, with the rotation angle limiting device being converted from the locked into the unlocked state by the supply of pressure medium via a control line for supplying and withdrawing pressure medium to and from the rotation angle limiting device or devices, with the control line not communicating with the device for supplying pressure medium and a control valve. This allows pressure medium to be supplied to the control line in an operational state and to be withdrawn from the control line in an idle state. The object is attained according to the invention in that the control valve is provided with a hydraulic actuating mechanism impinged with pressure medium by the device for supplying pressure medium.

By the embodiment of the device an electromagnetic actuator mechanism with its high costs and control-expenses is avoided. Additionally, electricity supplies to the control valve can be omitted, which tend to be defective, as well as any additionally necessary control software in the engine control unit (ECU). Furthermore, the operation of the control valve occurs via pressure medium in a secure process only at a time at which the device is already sufficiently impinged with pressure medium. Furthermore, no electric energy is necessary to operate and uphold the switch position of the switch-over valve.

Another advantage results from the rotation angle limiting device being automatically converted into a locked state when the system pressure provided by a pressure medium pump falls short of a certain value, at which the device is no longer sufficiently impinged with pressure medium and thus the phasing of the output element in reference to the input element can no longer be held in a secure functional state. This can occur, for example, when the internal combustion engine is idling and thus the pressure medium pump operated by the crankshaft cannot create sufficient pressure.

Here, it can be provided that the device to provide pressure medium is provided with a control valve, a first and a second pressure medium line, with the control valve communicating with a pressure medium pump, the pressure medium lines with the control valve and one of the pressure chambers each, and the hydraulic actuating mechanism with one of the pressure medium lines.

By these measures, using a simple start strategy, the filling of the two pressure chambers can be ensured prior to the operation of the control valve. For this purpose, after the start of the internal combustion engine first those pressure chambers or that pressure chamber can be impinged with pressure medium supplied by the pressure medium line, which does not communicate with the actuating mechanism. In a subsequent step the other pressure medium line, and thus the other group of pressure chambers or the other pressure chamber is impinged with pressure medium. This leads to an operation of the control valve and thus to an unlocking of the rotation angle limiting device. Due to the fact that at this time already all pressure chambers of the device are supplied with pressure medium, the control drive is in a stressed state. The reaction moments exercised by the camshaft on the input element cannot lead to an uncontrolled pivotal motion. This way, the wear of the device is minimized and an otherwise common development of noise is avoided.

In another embodiment of a device for variably setting control times of gas exchange valves of an internal combustion engine with a output element driving a camshaft, an input element driven by a crankshaft, with the two components being rotatable in reference to each other and defining at least one pressure chamber, with a blade extending in each pressure chamber, arranged at one of the components and dividing the pressure chamber into two reciprocally operating pressure chambers, two pressure medium lines, with each pressure medium line communicating with a pressure chamber or a group of pressure chambers, and with a phase position of the output element in reference to the input element being optionally held or adjusted by supplying and withdrawing pressure medium from and/or to the pressure chambers, at least one rotation angle limiting device, which does not limit the phasing of the output element in reference to the input element in an unlocked state and limits it in a locked state to a defined angular range or a defined angle, with the rotation angle limiting device being converted into the unlocked state and held there by pressure medium being supplied to a control line and a control valve, with the control line communicating with the control valve or the rotation angle limiting device and with the control valve in an operated state allowing the supply of pressure medium, and in an idle state the withdrawal of pressure medium from the control line. The object according to the invention is attained such that the control valve is provided with a hydraulic actuating mechanism and the actuating mechanism communicates with at least one of the pressure medium lines.

In this embodiment the same advantages are achieved as in the first embodiment.

In another advantageous further development of the invention it is provided that the control valve is provided with an operating connector, an inlet connector, and an outlet connector, with the operating connector communicating with the control line and the hydraulic actuating mechanism of the control valve, the inlet connector with the pressure medium pump, and the outlet connector with the reservoir.

This ensures that the rotation angle limiting device can also be kept in the unlocked state when the pressure chambers are not impinged with pressure medium via pressure medium lines communicating with the actuating mechanism.

In a more precise definition of the invention the rotation angle limiting device is embodied with a first receiver in the output element or the input element and with a first link provided on the other component, with in the first piston and a first spring located in the first receiver, with the first spring pushing the first piston into the direction of the component in which the first link is provided.

Here, the first link is provided as a blind hole or a staggered link with a blind hole, with the opening of the blind hole being adjusted to the dimensions of the locking piston.

Furthermore, a second rotation angle limiting device can be provided, which is provided with a second receiver in the output element or the input element and a second link provided on the other component, with a second piston and a second spring located in the second receiver, and the second spring pushes the second piston into the direction of the component at which the second link is provided. Here, the first link can be provided as a groove extending in the circumferential direction and the second link as a blind hole, with its opening being adjusted to the dimensions of the locking piston.

Alternatively it is provided, that the first and the second link are each provided as a groove extending in the circumferential direction.

These embodiments of the rotation angle limiting device are adjusted to certain locking positions, with a locking of the phasing of the output element in reference to the input element being realized in one of the extreme positions or a position therebetween.

BRIEF DESCRIPTION OF THE DRAWINGS

Further features of the invention are discernible from the following description and the drawing, in which exemplary embodiments of the invention are shown in a simplified manner. Shown are.

DETAILED DESCRIPTION OF THE PREFERRED EMBODIMENTS

Figure 1:
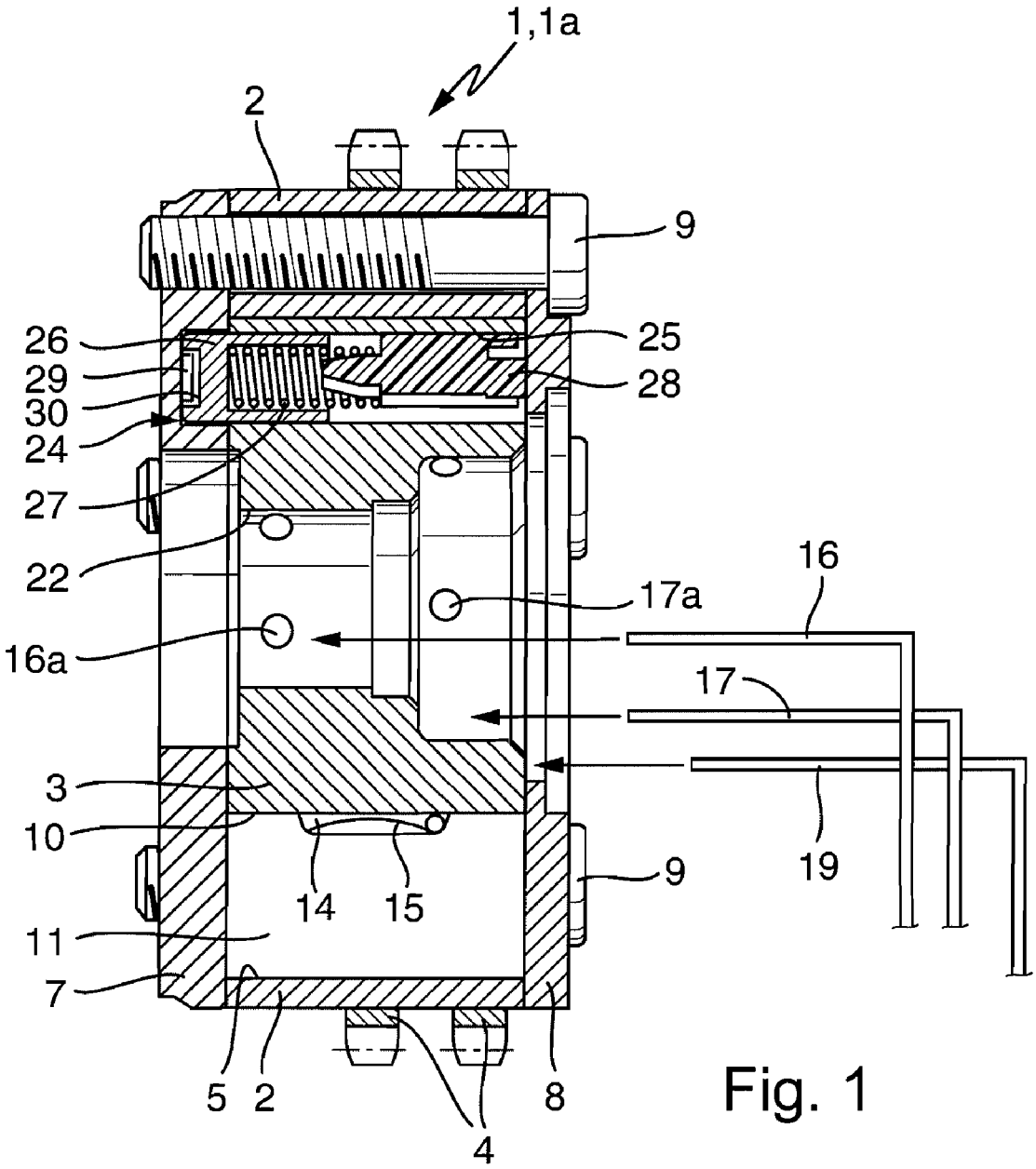
FIG. 1 a longitudinal cross-sectional view through a hydraulic actuator.
Figure 2:
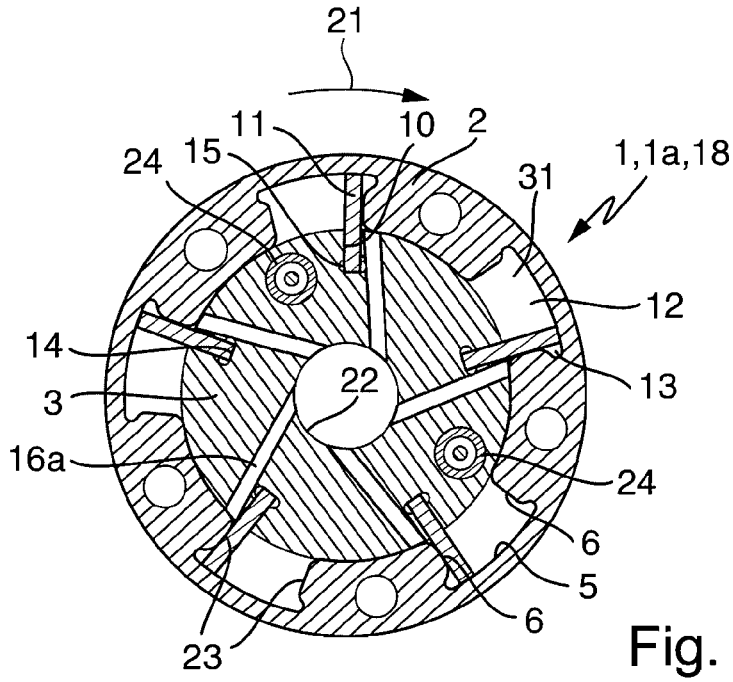
FIG. 2 a cross-sectional view through a hydraulic actuator according to FIG. 1, FIG. 2*a* a cross-sectional view through a second embodiment of a hydraulic actuator, FIG. 3 a schematic diagram of the pressure medium circuit of a device according to the invention having an actuator according to FIG. 2*a,*

FIGS. 1 and 2 show a first embodiment of a device 1 for variably adjusting the control times of gas exchange valves of an internal combustion engine. A control device la essentially comprises an input element 2 and an output element 3 arranged concentrically in reference thereto. A drive wheel 4 is connected to the input element 2 in a rotationally fixed manner and embodied as a chain wheel in the embodiment shown. Also possible are embodiments of the drive wheel 4 as a belt or toothed wheel. The input element 2 is rotatably supported on the output element 3, with at the internal casing surface of the input element 2 in the exemplary embodiment shown being provided with five recesses 5, spaced apart in the circumferential direction. The recesses 5 are limited in the radial direction by the input element 2 and the output element 3, in the circumferential direction by two lateral walls 6 of the input element 2, and in the axial direction by a first and a second side cap 7, 8. In this manner, each of the recesses 5 is sealed pressure-tight. The first and the second side cap 7, 8 are connected to the output element 2 in a rotationally fixed manner via connection elements 9, for example screws.

Axially extending blade grooves 10 are provided at the external casing surface of the output element 3, with one radially extending blade 11 being arranged in each blade groove 10. One blade 11 extends into each recess, with the blades 11 in the radial direction contacting the input element 2 and in the axial direction the side caps 7, 8. Each blade 11 divides a recess 5 into two reciprocally operating pressure chambers 12, 13. In order to ensure a pressure-tight contact of the blades 11 to the input element 2, blade spring elements 15 are arranged between the bottom of the grooves 14 of the blade grooves 10 and the blades 11, which impinge the blades 11 with a force in the radial direction.

The first and second pressure chambers 12, 13 can be connected via first and second pressure medium lines 16, 17, and via a control valve, not shown, to a pressure medium pump, also not shown, or a reservoir, also not shown. In this way, an actuator 18 is provided, which allows a relative rotation of the input element 2 in reference to the output element 3. Here, it is provided that either all first pressure chambers 12 are connected to the pressure medium pump and all second pressure chambers 13 to the reservoir and/or the precisely opposite configuration. When the first pressure chambers 12 are connected to the pressure medium pump and the second pressure chambers 13 to the reservoir, the first pressure chambers 12 expand at the expense of the second pressure chambers 13. This results in a displacement of the blades 11 in the circumferential direction, i.e. in the direction shown by the first arrow 21. By displacing the blades 11, the output element 3 is rotated in reference to the input element 2. In another control position of the control valve, both pressure medium lines 16, 17 are separated from the reservoir and the pressure medium pump. In this way the present phasing is maintained. Alternatively, a defined supply of the pressure medium can be permitted to the two pressure chambers 12, 13 in order to compensate any occurring loss by leaks.

The input element 2 is driven in the embodiment shown by the crankshaft via a chain drive, not shown, engaging its drive wheel 4. It is also possible to drive the input element 2 via a belt or toothed wheel drive. The output element 3 is connected to a camshaft, not shown, in a force, form, or material fitting manner, for example by way of interference fit or by a screwed connection. From the relative rotation of the output element 3 relative to the input element 2, as a consequence of the supply and/or withdrawal of pressure medium to and/or from the pressure chambers 12, 13, a phase shift results of the camshaft relative to the crankshaft. In this way, by a targeted supply and/or withdrawal of pressure medium to and from the pressure chambers 12, 13 the control times of the gas exchange valves of the internal combustion engine can be varied in a targeted manner.

Each of the pressure medium lines 16, 17 communicate with a pressure medium distributor, not shown, arranged in a central bore 22 of the output element 3, having one pressure medium channel 16*a,* 17*a* each, with each of the pressure medium channels 16*a,* 17*a* opening in one of the pressure chambers 12, 13.

Another possibility comprises the arrangement of a central valve in the central bore 22, by which the pressure medium channels 16*a,* 17*a* and thus the pressure chambers 12, 13 can be connected in a targeted fashion to a pressure medium pump and/or a reservoir.

The lateral walls 6 of the recesses 5, essentially extending radially, are provided with formations 23 extending in the circumferential direction in the recesses 5. The formations 23 serve as stops for the blades 11 and ensure that the pressure chambers 12, 13 can be supplied with pressure medium, even when the output element 3 is at one of the two extreme locations in reference to the input element 2, in which the blades 11 contact one of the lateral walls 6.

In case the supply of the device 1 with pressure medium is insufficient, for example during the start phase of the internal combustion engine or when idling, the output element 3 is moved in reference to the input element 2 in an uncontrolled manner due to the alternating and dragging moments the camshaft acts thereupon. In a first phase, the dragging moments of the camshaft push the output element 3, in reference to the input element 2, in a circumferential direction opposite the rotational direction of the input element 2 until it contacts the lateral walls 6. In the following, the alternating moments of the camshaft acting upon the output element 3 lead to an oscillation of the output element 3 and thus the blades 11 in the recesses 5, until at least one of the pressure chambers 12, 13 is completely filled with pressure medium. This leads to an increased wear and to noise developing in the device 1.

In order to avoid this, two rotation angle limiting devices 24 are provided in the device 1. Each rotation angle limiting device 24 comprises a cup-shaped piston 26, which is arranged in an receiver 25 of the output element 3. The piston 26 is impinged with a force in the axial direction by a spring 27. The spring 27 is supported in the axial direction on one side at a ventilation element 28, and with the axial end facing away it is arranged inside the cup-shaped embodied piston 26.

In the first side cap 7, for each rotation angle limiting device 24, one link 29 is provided such that the output element 3 can be locked in its position in reference to the input element 2, which is equivalent to a best possible position for starting and/or idling of the internal combustion engine. In this position, the pistons 26 are pushed into the links 29 by the springs 27 when the supply of pressure medium to the device 1 is insufficient. Furthermore, means are provided in order to push the pistons 26 back into the recesses 25, when the supply of pressure medium to the device 1 is sufficient, and thus to open the lock. In the embodiment shown, the links 29 are impinged with pressure medium via pressure medium channels and recesses 30, not shown. The pressure medium supplied to the links 29 pushes the pistons 26 against the force of the springs 27 back into the recesses 25, by which the fixed phase ratio between the output element 3 and the input element 2 is cancelled. The pressure medium is supplied to the links 29 via a control line 19 and pressure medium channels, not shown.

Figure 2A:
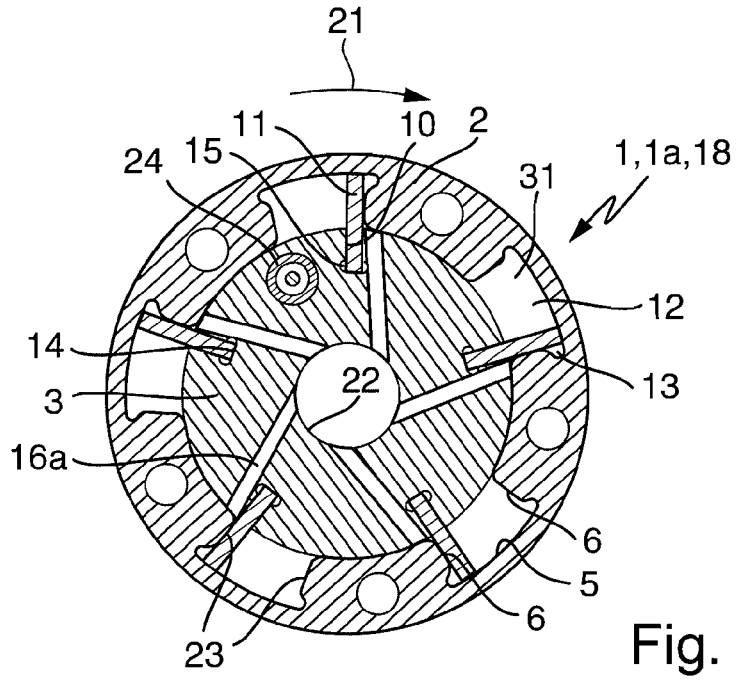

FIG. 2*a* shows an alternative embodiment of a device 1. This is essentially identical to the device 1 shown in FIG. 2, thus identical components are identified by the same reference characters.

In contrast to the embodiment shown in FIG. 2 it is provided with only one rotation angle limiting device 24.

Figure 3:
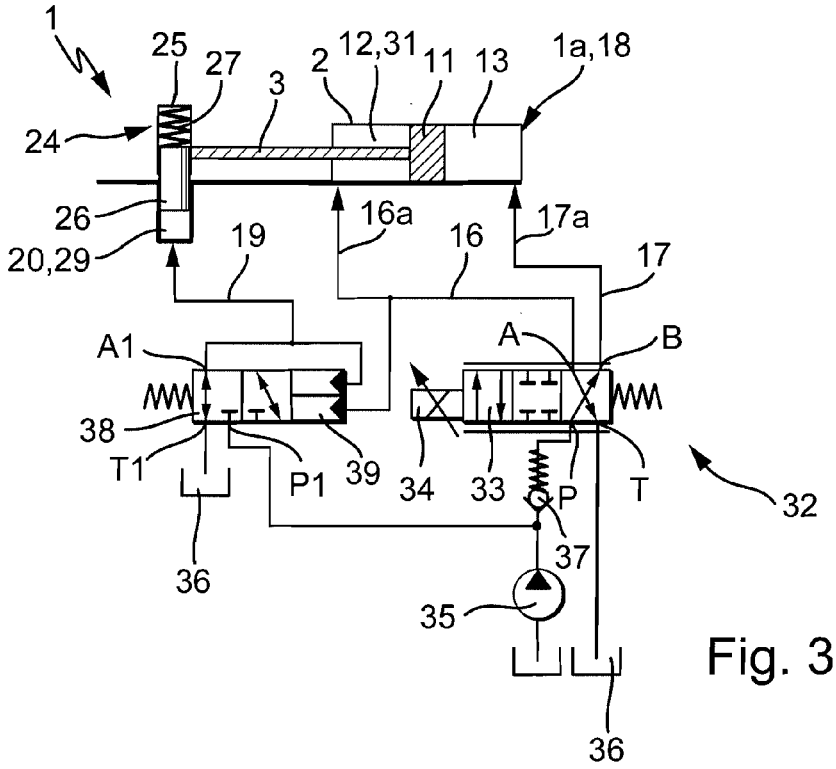
Figure 4:
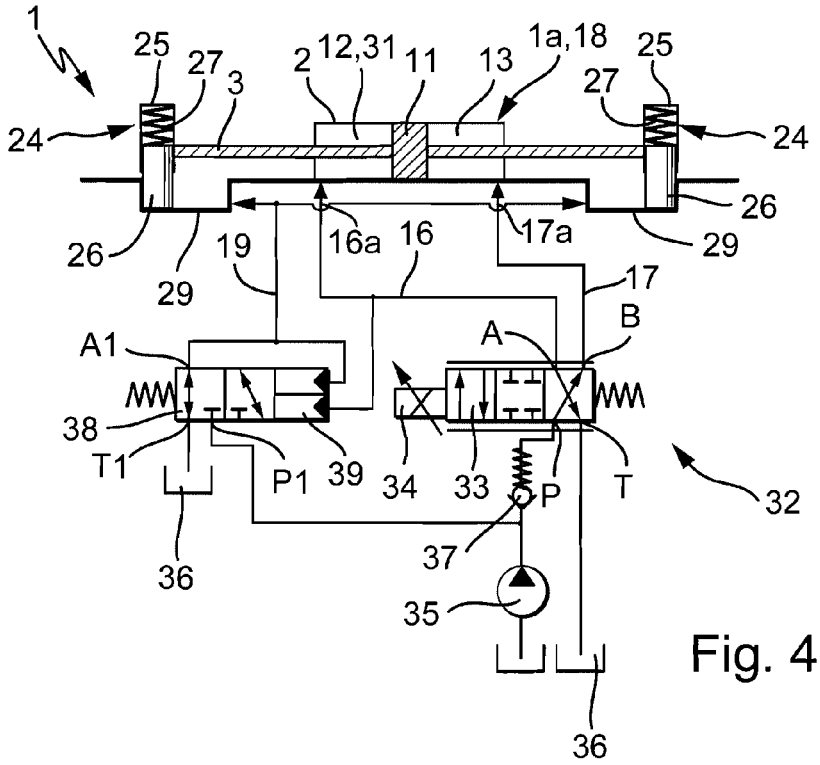
FIG. 4 a schematic diagram of the pressure medium circuit of a device according to the invention with an actuator according to FIG. 2, FIG. 5 a schematic diagram of the pressure medium circuit of a device according to the invention with an actuator according to FIG. 2 in another embodiment of the rotation angle limiting device.
Figure 5:
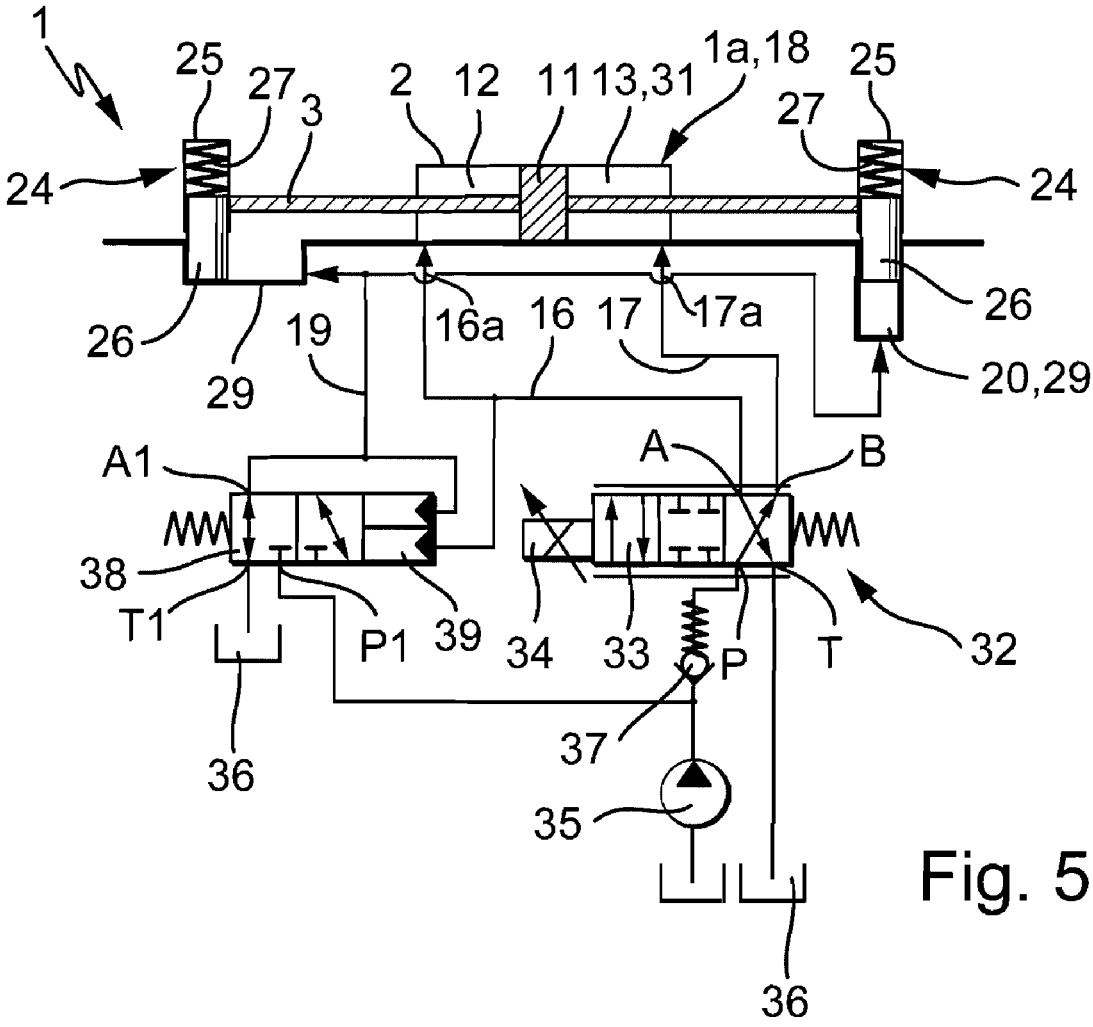

FIGS. 3 through 5 show schematic representations of a device 1 with differently embodied rotation angle limiting devices 24. Each of the devices 1 comprises an input element 2, in which a pressure chamber 31 is embodied. Furthermore, one or more links 29 are provided at the input element 2. A blade 11 of the output element 3 extends into the pressure chamber 31. Furthermore, at the output element 3, recesses 25 are provided, in each of which a piston 26 is embodied, each being pushed into the direction of the input element 2 by a spring 27.

By feeding pressure medium to the pressure chambers 12, 13, the blade 11 can optionally be displaced or held in a certain position inside the pressure chamber 31, when the rotation angle limiting device 24 is released, with the phasing of the output element 3 in reference to the input element 2 and thus the phasing of the camshaft in reference to the crankshaft being varied or held.

Furthermore, a pressure medium supply device 32 is provided, by which pressure medium can be supplied and/or withdrawn in a targeted fashion to and from pressure chambers 12, 13. The pressure medium supply device 32 comprises a control valve 33, first and second pressure medium lines 16, 17, and pressure medium channels 16*a*, 17*a*. The control valve 33 is embodied as a 4/3 port valve, which can move an actuator 34 into three control positions. The control valve 33 is provided with two operating connectors A, B, an inlet connector P, and an output connector T. The input connector P communicates with a pressure medium pump 35, the outlet connector T with a reservoir 36, the operating connector A via the first pressure medium line 16 and the first pressure medium channel 16*a* with the first pressure chamber 12 and the second operating connector B via the second pressure medium line 17 and the second pressure medium channel 17*a* with the second pressure chamber 13.

In FIG. 3, a first embodiment of the device 1 is shown, in which only one rotation angle limiting device 24 is provided. Using this type of device 1, the phasing between the output element 3 and the input element 2 can be fixed in one of the extreme positions or an intermediate position. Here, the link 29 is embodied as a blind hole 20, with the cross-section of the opening of the blind hole 20 being adjusted to the cross-section of the piston 26. When the piston 26 engages the link 29, as shown in FIG. 3, the output element 3 is connected mechanically to the input element 2 and thus its phasing is fixed to a defined value. This is equivalent to a locked condition of the rotation angle limiting device 24.

In order to allow a change of the phasing between the output element 3 in reference to the input element 2 the rotation angle limiting device 24 must be converted into the unlocked state, in which the piston 26 is pushed into the recess 25 against the force of the spring 27 to such an extent that it no longer engages the link 29. For this purpose the control line 19 is provided, by which pressure medium can be fed to the link 29.

In order to achieve a targeted unlocking or locking of the rotation angle limiting device 24, a switch-over valve 38 is provided, which is arranged between the pressure medium pump 35 and the control line 19. The switch-over valve 38 controls the flow of pressure medium from the pressure medium pump 35 to the control line 19 and/or from the control line 19 to the reservoir 36.

The switch-over valve 38 is embodied as a 3/2 port valve in the embodiment shown. Here, an operating connector Al, an inlet connector P1, and an outlet connector T1 is provided for the switch-over valve 38. The operating connector A1 communicates with the control line 19, the outlet connector T1 with the reservoir 36, and the inlet connector P1 with the pressure medium pump 35.

In a first control position of the switch-over valve 38, shown in FIG. 3, the operating connector A1 is connected to the outlet connector T1. In this setting the link 29 is kept free from pressure, by which the piston 26 is held in the link 29. The rotation angle limiting device 24 is in a locked state.

In the second control setting of the switch-over valve 38, the operating connector A1 is connected to the inlet connector P1, with pressure medium being fed to the link 29 and thus the piston 26 is pushed out of the link 29. In this case the rotation angle limiting device 24 switches from the locked into the unlocked setting, and the phasing of the device 1 can be changed.

In the embodiment shown a check valve 37 is arranged between the pressure medium pump 35 and the control valve 33, which prevents pressure peaks developing in the device 1 by the reaction moments of the camshaft from extending to the pressure medium pump 35. The inlet connector P1 of the control valve 38 is supplied by the pressure medium pump 35 via a pressure line, with said branching being located upstream in reference to the return valve 37. The unlocking of the rotation angle limiting device 24 occurs therefore via system pressure. This means, the hydraulic system for unlocking the rotation angle limiting device 24 does not communicate with the pressure medium supply device 32 of device 1. This is advantageous in that the pressure peaks are not fed into the system for unlocking the rotation angle limiting device 24. This prevents unintended unlocking processes of the rotation angle limiting device 24 from developing due to pressure peaks.

In addition to pressure peaks, the reaction moment of the camshaft causes pressure fluctuations in the hydraulic system of the device 1. By the uncoupling of the rotation angle limiting device 24 from these pressure fluctuations, an unintended unlocking and locking of the rotation angle limiting device 24 is avoided.

The control valve 38 is provided with a hydraulic actuating mechanism 39, by which the control valve 38 can be adjusted between the two control settings. The actuating mechanism 39 communicates with a pressure medium line 16, 17 such that the control valve 38 is converted into the second control setting, when the pressure exceeds a certain limit in this pressure medium line 16, 17.

In the embodiment shown the actuating mechanism 39 communicates with the first pressure medium line 16, which in turn communicates with the operating connector A of the control valve 33. After the start of the internal combustion engine the control valve 33 is in the setting shown. The pressure medium pump 35 is connected to the second pressure chamber 13 via the second pressure medium line 17. This results in the second pressure chamber 13 being filled with pressure medium. After a certain amount of time the control valve 33 switches into the third control setting, by which pressure medium is supplied to the first pressure chamber 12 via the first pressure medium line 16. Simultaneously, the hydraulic actuating mechanism 39 is impinged with pressure medium, resulting in the control valve 38 being switched into the second control setting. In this way, pressure medium is supplied from the pressure medium pump 35 to the link 29 with the consequence that the rotation angle limiting device 24 is switched into the unlocked setting. Due to the fact that both pressure chambers 12, 13 have already been filled with pressure medium, the device 1 is in a defined state and an uncontrolled oscillation of the output element 3 in reference to the input element 2 is prevented.

Using this method during the start of the internal combustion engine it is ensured that the rotation angle limiting device 24 is not switched into the unlocked state until a time when both pressure chambers 12, 13 have already been filled with pressure medium. The blade 11 of the output element 3 is therefore clamped hydraulically in reference to the input element 2, thus said element is in a defined phasing, a contact of the blade 11 with the lateral walls 6 is excluded, and thus no noise develops and no increased wear is to be feared.

Furthermore, the operating connector A1 of the control valve 38 is also connected to the actuating mechanism 39. When the actuating mechanism 39 is activated for the first time via the first pressure medium line 16 pressure medium is supplied to both the link 29 as well as the actuating mechanism 39 via the control valve 38. This ensures that the control valve 38 is held in the second control setting until the pressure created by the pressure medium pump 35 has collapsed or until the system pressure has fallen below a certain value. This therefore relates to a self-sustaining mechanism for the control valve 38. If now via the control valve 33 the second pressure medium line 17 is connected to the pressure medium pump 35, and thus the first pressure medium line 16 to the reservoir 36, the control valve 38 is held in the second control setting by this self-sustaining mechanism and thus the link 29 continues to be impinged with pressure medium. This secure function prevents an unintended adjustment of the rotation angle limiting device 24.

Compared to the embodiment disclosed in prior art having an electro-mechanic actuating mechanism, here no type of controller for the control valve 38 is necessary. At the moment the system pressure supplied by the pressure medium pump 35 exceeds a predetermined value, the link 29 is impinged with pressure medium until the system pressure again falls short of the predetermined value. Another advantage comprises that the hydraulic actuating mechanism 39 can be produced in a cost effective manner in reference to an electromagnetic one, is less susceptible to defects, and requires no ECU for control. Another advantage comprises that the control valve 38 is automatically switched into the first control setting, when the system pressure falls short of a certain value, at which the device 1 no longer can be operated with a secure function. This can occur, for example, when the internal combustion engine is idling. In this case the rotation angle limiting device 24 is switched into the locked state. In this way, an undesired noise development is avoided and wear is prevented. Furthermore, the output element 3 is held in an optimal phase position for this operational state in reference to the input element 2.

When the system pressure again exceeds the predetermined value, the rotation angle limiting device 24 is once more unlocked automatically and the phasing of the output element 3 in reference to the input element 2 can be variably adjusted according to the range of characteristics stored.

FIGS. 4 and 5 show two additional devices 1, which differ from the device 1 shown in FIG. 3 in that two rotation angle limiting devices 24 are provided. This embodiment is particularly suitable for the locking of the output element 3 in reference to the input element 2 in a phase position between the two potential extreme settings.

In FIG. 4 both links 29 of the rotation angle limiting devices 24 are embodied as grooves. Here, the grooves are arranged such that a rotation angle limiting device 24 limits the phase position between a maximum late adjustment of the output element 3 in reference to the input element 2 and an intermediate position, while the second rotation angle limiting device 24 limits the phase position of the output element 3 in reference to the input element 2 to a range from an intermediate position to a maximum early adjustment. When both rotation angle limiting devices 24 are in the locked position the output element 3 is held in the central position in reference to the input element 2.

In FIG. 5 one of the links 29 is embodied as a blind hole 20 and the second link 29 as a groove. Here, the rotation angle limiting device 24 with the link 29 embodied as a groove limits the phase position of the output element 3 in reference to the input element 2 for a certain angular range, which extends between a central position and either to a maximum early position or a maximum late position. The blind hole 20 is arranged such that this rotation angle limiting device 24 can only be switched into the locked state in said intermediate position.

Of course many variations of the invention are possible in addition to the disclosed embodiments. For example, the piston 26 can be arranged in the input element 2 and the link 29 in the output element 3. Furthermore, instead of an axial locking device a radial locking direction is possible. It is also possible that the embodiment shown in FIG. 3 with a rotation angle limiting device 24 being in a locked state when the blade 11 contacts the lateral walls 6 or takes a defined position between the lateral walls 6. Furthermore, various embodiments of the control valve 33 are possible, (for example as 4/4 or 4/5 port valves.) Also, several embodiments of the piston 26 are possible, for example in form of pins, plates, and the like.

List of Reference Characters

1 device
1*a* control device
2 input element
3 output element
4 drive wheel
5 recesses
6 lateral wall
7 first side cap
8 second side cap
9 connection element
10 blade groove
11 blade
12 first pressure chamber
13 second pressure chamber
14 bottom of the groove
15 flat spring element
16 first pressure medium line
16*a* first pressure medium channel

17 second pressure medium line
17*a* second pressure medium channel
18 actuator
19 control line
20 blind hole
21 first arrow
22 central bore
23 formations
24 rotation angle limiting device
25 receiver
26 piston
27 spring
28 ventilation element
29 link
30 recess
31 pressure chamber
32 device for supplying pressure medium
33 control valve
34 actuator
35 pressure medium pump
36 reservoir
37 return valve
38 actuating mechanism
P, P1 inlet connector
T, T1 outlet connector
A, A1 first operation connector
B second operating connector

The invention claimed is:

1. A device for variably adjusting the control times of gas exchange valves in an internal combustion engine comprising:

an output element driving a camshaft, an input element driven by a crankshaft, a hydraulic actuator with at least two reciprocally operating pressure chambers, and a device for supplying pressure medium for a supply to and withdrawal of pressure medium from the pressure chambers, the input element being rotatable relative to the output element and phasing between the input and output elements can be selectively held or adjusted by supplying and withdrawing pressure medium to and/or from the pressure chambers, at least one rotation angle limiting device, which does not limit phasing of the output element in reference to the input element in an unlocked state and in a locked state limits phasing to a defined angular range or a defined angle, the at least one rotation angle limiting device being switchable from the locked into the unlocked state by a supply of pressure medium, a control line for supplying and withdrawing pressure medium to or from at least one the rotation angle limiting device, with the control line not communicating with the pressure medium supply device and a control valve allowing in an operating state the supply of pressure medium to and in an idle state a removal of pressure medium from the control line, the control valve is provided with a hydraulic actuating mechanism, which is impinged with pressure medium by the pressure medium supply device.

2. A device according to claim 1, wherein the pressure medium supply device comprises a control valve, a first and a second pressure medium line the control valve communicates with a pressure medium pump, the pressure medium lines and each of the pressure chambers, and the hydraulic actuating mechanism communicates with one of the pressure medium lines.

3. A device according to claim 1, wherein the control valve is provided with an operating connector, an inlet connector, and an output connector, with the operating connector communicating with a control line and the hydraulic actuating mechanism of the control valve, the inlet connector communicating with a pressure medium pump and the outlet connector communicating with a reservoir.

4. A device according to claim 1, wherein the rotation angle limiting device is provided with a first receiver in the output element or the input element, and a first link is provided on the other of the output element or the input element with a first piston and a first spring being accepted in the first receiver, and the first spring pushing the first piston in a direction of the other of the output element or the input element in which the first link is provided.

5. A device according to claim 4, wherein a second rotation angle limiting device is provided, which is provided with a second receiver located in the output element or the input element and a second link provided on the other of the output element or the input element with a second piston and a second spring being accepted in the second receiver, and the second spring pushes the second piston in a direction of the other of the output element or the input element in which the second link is provided.

6. A device according to claim 5, wherein the first link comprises a blind hole, with an opening thereof being adjusted to dimensions of the piston.

7. A device according to claim 6, wherein the first link comprises a groove extending in a circumferential direction and the second link comprises a blind hole, with an opening thereof being adjusted to dimensions of the piston.

8. A device according to claim 7, wherein the first and the second link each comprise grooves extending in the circumferential direction.

9. A device for variably adjusting the control times of gas exchange valves of an internal combustion engine comprising an output element driving a camshaft, an input element driven by a crankshaft, with the input and output elements being mounted rotatable relative to each other and defining at least one pressure chamber, with at least one blade arranged at one of the input and output elements extending into a respective one of the at least one pressure chambers and dividing the respective at least one pressure chamber into two reciprocally operating pressure chambers, two pressure medium lines with each of the pressure medium lines communicating with one of the pressure chambers or a group of the pressure chambers and with phasing of the output element in reference to the input element optionally being held or adjusted by supplying or withdrawing pressure medium to and/or from the pressure chambers, at least one rotation angle limiting device, not limiting the phasing of the output element relative to the input element in an unlocked state and in a locked state limiting phasing to a the defined angular range or a defined angle, with the at least one rotation angle limiting device being switched into and held in the unlocked state by the supply of pressure medium, a control line and a control valve, the control line communicating with the control valve and the rotation angle limiting device and the control valve allowing in an operative state the pressure medium supply to and in an idle state withdrawal of the pressure medium from the control line the control valve is provided with a hydraulic actuating mechanism and the actuating mechanism communicates with at least one of the pressure medium lines.

10. A device according to claim 9, wherein the rotation angle limiting device is provided with a first receiver in the output element or the input element, and a first link is provided on the other of the output element or the input element with a first piston and a first spring being accepted in the first receiver, and the first spring pushing the first piston in a direction of the other of the output element or the input element in which the first link is provided.

11. A device according to claim 10, wherein a second rotation angle limiting device is provided, which is provided with a second receiver located in the output element or the input element and a second link provided on the other of the output element or the input element with a second piston and a second spring being accepted in the second receiver, and the second spring pushes the second piston in a direction of the other of the output element or the input element in which the second link is provided.

12. A device according to claim 11, wherein the first link comprises a blind hole, with an opening thereof being adjusted to dimensions of the piston.

13. A device according to claim 12, wherein the first link comprises a groove extending in a circumferential direction and the second link comprises a blind hole, with an opening thereof being adjusted to dimensions of the piston.

14. A device according to claim 13, wherein the first and the second link each comprise grooves extending in the circumferential direction.

* * * * *